United States Patent [19]

Hegna

[11] 4,382,605

[45] May 10, 1983

[54] TILT STEERING OF TANDEM WHEELED OR RUNNER EQUIPPED VEHICLE

[76] Inventor: Hans O. Hegna, 2113 Mariner's Dr., Newport Beach, Calif. 92660

[21] Appl. No.: 182,108

[22] Filed: Aug. 28, 1980

[51] Int. Cl.[3] ..... A63C 17/02

[52] U.S. Cl. ..... 280/11.22; 280/11.2; 280/7.13

[58] Field of Search ..... 280/11.22, 11.23, 11.28, 280/11.27, 11.19, 11.2, 7.14, 7.13

[56] References Cited

U.S. PATENT DOCUMENTS

| | | | |
|---|---|---|---|
| 177,567 | 5/1876 | Saladee | 280/11.19 |
| 3,339,936 | 9/1967 | Hamlin | 280/11.2 |
| 4,114,913 | 9/1978 | Newell et al. | 280/7.14 X |
| 4,234,204 | 11/1980 | Tibbals | 280/11.2 X |
| 4,272,090 | 6/1981 | Wheat | 280/11.22 |

FOREIGN PATENT DOCUMENTS

| | | | |
|---|---|---|---|
| 3445 | of 1876 | United Kingdom | 280/11.27 |
| 145838 | 6/1920 | United Kingdom | 280/11.23 |

*Primary Examiner*—Robert J. Spar
*Assistant Examiner*—Donald W. Underwood
*Attorney, Agent, or Firm*—Hans Olav Hegna

[57] ABSTRACT

This invention pertains to a novel approach toward steering of vehicles such as roller skates, skateboards, bicycles, motorcycles & etcetera where the wheels or runners of such vehicle are arranged in a tandem configuration and the steering achieved through sidewise tilt of the vehicle.

9 Claims, 7 Drawing Figures

TILT STEERING OF TANDEM WHEELED OR RUNNER EQUIPPED VEHICLE

The invention consists of a novel approach for steering of a vehicle which wheels or runners are in a tandem configuration. Any of the two or more wheels are connected to a pair of jointed or resilient non-parallel arms or suspension members which are arranged so as to turn the wheelaxles in the desired way when wheels are forced to move relative to vehicle frame in a lateral direction. This—at least to some extent—is accomplished through a sidewise tilting of vehicle frame. In stead of any wheel the vehicle may be equipped with a runner or a bogie which has two wheels (which again might be replaced with runners) in tandem—such bogie is then steered as an assembly in a way similar to that of the original wheel as well as the wheels within the bogie being turned individually resulting in a substantial tracing of all wheels.

Figure 4:
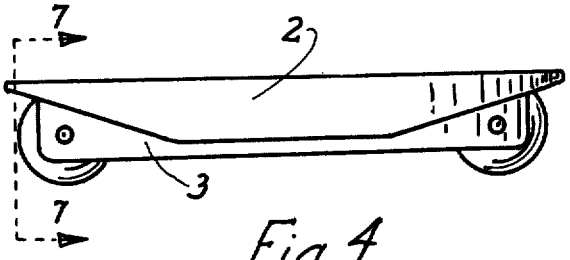
FIG. 4 shows a two wheeled version, not necessarily a skate.
Figure 7:
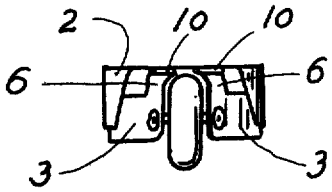
Figure 5:
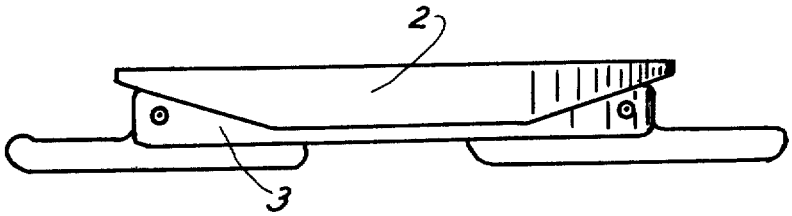
FIG. 5 shows a vehicle with two runners.
Figure 6:
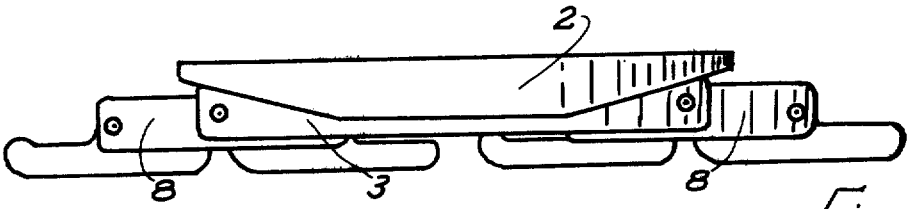

FIG. 6 four runners on two bogies,

FIG. 7 is a frontal view of FIG. 4 showing friction dampening and auxiliary support pads 10.

Figure 1:
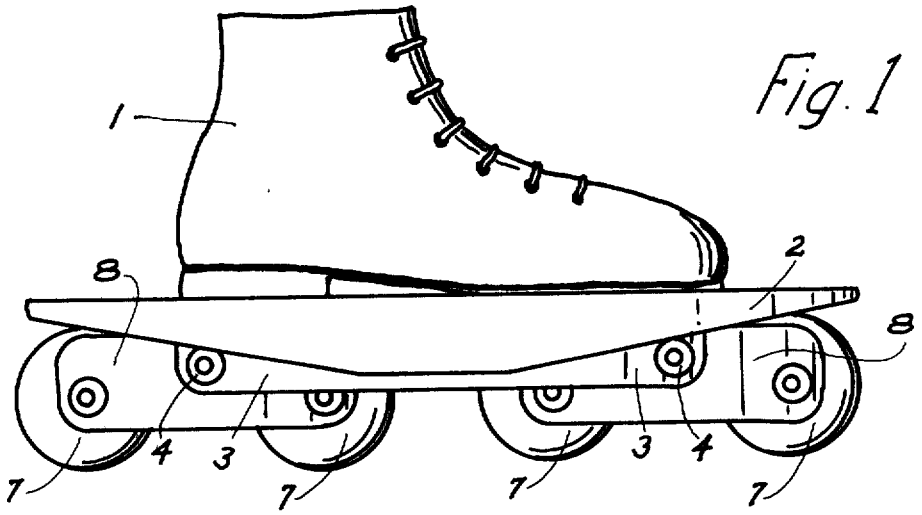
FIG. 1 shows a side view of a double bogie roller skate vehicle.
Figure 2:
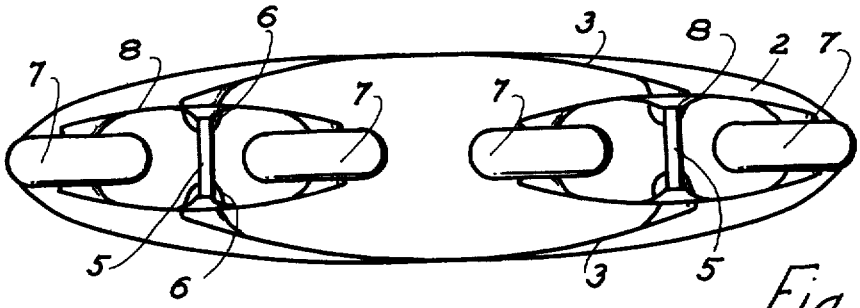
FIGS. 2 and 3 depict the mechanism from underneath when it is set to move straight ahead (or backwards) and when it is set to move in a curve respectively.
Figure 3:
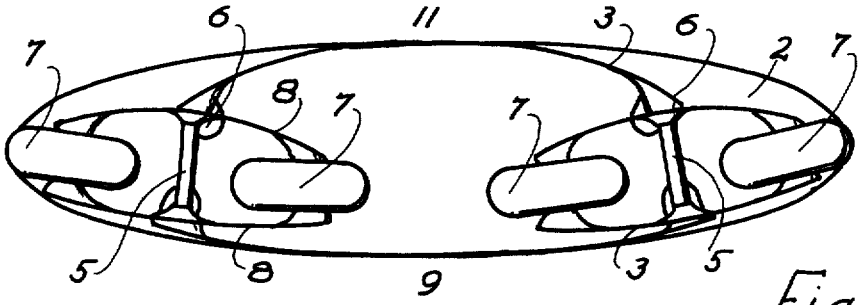

Referring to FIG. 1, the operator's foot will be inserted into boot 1 which is fixed to vehicle frame 2. Attached to the inside of vertical projections on each side of frame 2 are two pairs of suspension members 3; each within a pair to either side of the frame and each pair projecting forward or rearward, the suspension members are resilient laterally but less so vertically and at each of the four free ends are bearings 4 through which bogie pivots 5 pass and which will permit bogies to rock up and down as wheels go over unevennesses in the road as well as permit relative angular horizontal displacement between suspension members 3 and pivots 5, thus allowing for a steered position such as shown in FIG. 3. Lips 6 help prevent vertical flexing of suspension members 3 by resting against bottom of frame 2 on pads of relative low friction material such as e.g. teflon, thus not materially impairing lateral movements of suspension members 3. Any system comprising a mass attached to a resilient member is subject to oscillation and might need dampening means to keep such oscillations under control. FIG. 7 shows how friction pads 10 on lips 6 serve to dampen lateral oscillations of suspension members 3 as well as to prevent collapse of said suspension members when exposed to high vertical stress such as might occur if operator of vehicle lands after performing a jump. As previously mentioned FIG. 2 shows the mechanism depicted in FIG. 1 as seen from below in a neutral condition where wheels 7 are aligned in a straight line because operator's ankle is held so as to keep frame 2 laterally horizontal. If—however—the ankle and thus frame is tilted to one side, the weight of the operator will force suspension members 3 to yield sidewise and—due to their non-parallel geometry within a pair attached to the same bogie—turn bogie pivots 5 to make the vehicle turn as shown in FIG. 3. This is accomplished through increasing the distance between—referring to the tilt of an imaginary plane substantially containing the centerlines of bogie pivots 5 as well as of the wheel axles and serving to define uphill and downhill ends of pivots and axles—uphill ends of bogie pivots 5 by straightening of both uphill suspension members 3 and decreasing the distance between downhill ends of bogie pivots at downhill suspension members bend increasingly. In FIG. 3 uphill side of the imaginary plane will be recognized by the numeral 9 while downhill side is marked with numeral 11. Within each bogie a similar action takes place and makes laterally resilient sub-suspension members 8 turn wheels 7 within their bogie as well. The net result is that all wheels 7 trace in a curved path and the operator will thus turn on his skate. Since the arrangement is such that the ensuing centrifugal force will to some extent tend to cancel the lateral bias induced by the tilt of operator's ankle, a stable condition will result with balancing of the influences of ankle tilt and resiliency and geometry of suspension members 3 and sub-suspensiom members 8 versus centrifugal force induced through speed of vehicle and radius of turn. Contrary to conventional roller skates, the tandem wheel variety is not prone to jerks of directional changes when one wheel hits an unevenness in the road; the wheel simply heaves over the obstruction with very slight effect on the steering of the vehicle. With bogies the accompanying jolt is furthermore substantially ameliorated as the vertical movement of the pivot 5 will be about half that of a wheel within the bogie. The overhang of frame 2 over first and last wheel serves two purposes; it prevents eventual water and dirt from splattering on operator and it permits braking of either wheel by tipping skate forwards or backwards until overhang contacts the respective wheel and slows vehicle down. The invention is not—however—limited to roller skates but is also applicable to—among other things—skateboards, sleighs, bicycles and motorcycles, hence tilted "Tilt Steering of Tandem Wheeled or Runner Equipped Vehicle."

What is claimed is:

1. A mechanism for steering a vehicle having two wheels in a tandem configuration and having a frame which has approximately vertical projections on each side, and two pairs of laterally resilient suspension members attached to said projections and projecting substantially fore and aft, each suspension member within a pair being attached to either side of said frame and being not parallel to the longitudinal vehicle axis but rather the forward pair converging forward toward said vehicle axis and the rearward pair converging rearward toward said vehicle axis; and the free ends of each pair of suspension members being attached to either end respectively of a wheel axle in such a way as to permit some horizontal angular displacement between each said wheel axle and its suspension members, and one of said wheels supported on bearings on each said wheel axle so that when said vehicle is being tilted to one side by an operator said suspension members will yield laterally relative to said frame due to the influence of gravity, and because of their unparallel geometry relative to said vehicle axis they will move relative to the tilt of said axles with the uphill end of the front wheel axle moving forward and the downhill end of said front wheel axle moving rearward and the uphill end of the rear wheel axle moving rearward and the downhill end of said rear wheel axle moving forward thus forcing a turn of at least one of the wheel axles and causing a moving vehicle to execute a turn.

2. A mechanism for steering a vehicle having two runners in a tandem configuration and having a frame which has approximately vertical projections on each side, and two pairs of laterally resilient suspension members attached to said projections and projecting substantially fore and aft, each suspension member within a pair being attached to either side of said frame and being not parallel to the longitudinal vehicle axis but rather the forward pair converging forward toward said vehicle axis and the rearward pair converging rearward toward said vehicle axis; and the free ends of each pair of suspension members being attached to either end respectively of a runner axle in such a way as to permit some horizontal angular displacement between each said runner axle and its suspension members, and one of said runners supported rotatably on each said runner axle to permit rocking of runners in conformance with terrain over which vehicle is being used; and when said vehicle is being tilted to one side by an operator said suspension members will yield laterally relative to said frame due to the influence of gravity, and because of their unparallel geometry relative to said vehicle axis they will move relative to the tilt of said axles with the uphill end of the front runner axle moving forward and the downhill end of said front runner axle moving rearward and the uphill end of the rear runner axle moving rearward and the downhill end of said rear runner axle moving forward thus forcing a turn of at least one of the runner axles and causing a moving vehicle to execute a turn.

3. A mechanism for steering a vehicle having at least three wheels in a tandem configuration and having a frame which has approximately vertical projections on each side, and two pairs of laterally resilient suspension members attached to said projections and projecting substantially fore and aft, each suspension member within a pair being attached to either side of said frame and being not parallel to the longitudinal vehicle axis but rather the forward pair converging forward toward said vehicle axis and the rearward pair converging rearward toward said vehicle axis, and at least one pair of the free ends of said suspension members being attached to either end respectively of a bogie pivot in such a fashion as to permit some angular horizontal displacement between said bogie pivot and said suspension members, and two pairs of laterally resilient sub-suspension members each pair of which is being mounted on either side of said bogie pivot and projecting substantially fore and aft and forming a bogie which is being made free to rock around a substantially horizontal axis normally approximately transverse to said vehicle axis and defining the pivot of the bogie, and said forward pair of said sub-suspension members converging forward toward the longitudinal axis of the associated bogie and said rearward pair converging rearward toward said longitudinal axis of said associated bogie, and each of the free ends of each pair of sub-suspension members being attached to either end respectively of a wheel axle in such a way as to permit some horizontal angular displacement between said wheel axle and said sub-suspension members, and wheels supported on bearings on said wheel axles so that when said vehicle is being tilted to one side by an operator said suspension members will yield laterally relative to said frame due to the influence of gravity, and because of their unparallel geometry relative to said vehicle axis they will move relative to the tilt of said bogie pivots with the uphill end of the front bogie pivot moving foward and the downhill end of said front bogie pivot moving rearward and the uphill end of the rear bogie pivot moving rearward and the downhill end of said rear bogie pivot moving forward thus forcing a turn of at least one bogie pivot and thus bogie, and within each bogie deflections of the sub-suspension members similarly forcing the uphill ends of the wheel axles apart and the downhill ends together giving a net result of all wheels in the vehicle tracing in a curve and causing a moving vehicle to execute a turn.

4. A mechanism for steering a vehicle having at least three runners in a tandem configuration and having a frame which has approximately vertical projections on each side, and two pairs of laterally resilient suspension members attached to said projections and projecting substantially fore and aft, each suspension member within a pair being attached to either side of said frame and being not parallel to the longitudinal vehicle axis but rather the forward pair converging forward toward said vehicle axis and the rearward pair converging rearward toward said vehicle axis, and at least one pair of the free ends of said suspension members being attached to either end respectively of a bogie pivot in such a fashion as to permit some angular horizontal displacement between said bogie pivot and said suspension members, and two pairs of laterally resilient sub-suspension members each pair of which is being mounted on either side of said bogie pivot and projecting substantially fore and aft and forming a bogie which is being made free to rock around a substantially horizontal axis normally approximately transverse to said vehicle axis and defining the pivot of the bogie, and said forward pair of said sub-suspension members converging forward toward the longitudinal axis of the associated bogie and said rearward pair converging rearward toward said longitudinal axis of said associated bogie and each of the free ends of each pair of sub-suspension members being attached to either end respectively of a runner axle in such a way as to permit some horizontal angular displacement between said runner axle and said sub-suspension members, and runners suported rotatably on said runner axles to permit rocking of the runners in conformance with terrain over which vehicle is being used; and when said vehicle is being tilted to one side by an operator said suspension members will yield laterally relative to said frame due to the influence of gravity, and because of their unparallel geometry relative to said vehicle axis they will move relative to the tilt of said bogie pivots with the uphill end of the front bogie pivot moving forward and the downhill end of said front bogie pivot moving rearward and the uphill end of the rear bogie pivot moving rearward and the downhill end of said rear bogie pivot moving forward thus forcing a turn of at least one bogie pivot and thus bogie, and within each bogie deflections of the sub-suspension members similarly forcing the uphill ends of the runner axles apart and the downhill ends together giving a net result of all runners in the vehicle tracing in a curve and causing a moving vehicle to execute a turn.

5. A mechanism as described in claim 3 and where the frame of the vehicle is extended over either the front or rear end of the vehicle and said frame having a substantially horizontal brake surface underneath the frame extension so that when the vehicle is being—for front wheel engagement—tipped forward until the rear wheel or wheels leave the ground the brake surface can be made to contact the foremost wheel of the front bogie and thereby brake the vehicle's progress, or—for rear wheel engagement—tipped rearward until the front wheel or wheels leave the ground making possible brake surface contact with the rearmost wheel of the rear bogie and similarly brake vehicle.

6. A mechanism as described in claim 1 and having near the free ends of the suspension members approximately horizontal friction pads affixed on top of horizontal lips on the free ends, and said friction pads rubbing against a surface on the underside of the frame whenever said suspension members yield laterally and intended to serve two functions; dampening of oscillations is suspension members and aiding in the vertical support of the wheels.

7. A mechanism as described in claim 2 and having near the frame ends of the suspension members approximately horizontal friction pads affixed on top of horizontal lips on the free ends, and said friction pads rubbing against a surface on the underside of the frame whenever said suspension members yield laterally and intended to serve two functions; dampening of oscillations in suspension members and aiding in the vertical support of the runners.

8. A mechanism as described in claim 3 and having near the free ends of the suspension members approximately horizontal friction pads affixed on top of horizontal lips on the free ends, and said friction pads rubbing against a surface on the underside of the frame whenever said suspension members yield laterally and intended to serve two functions; dampening of oscillations in suspension members and aiding in the vertical support of the bogies.

9. A mechanism as described in claim 4 and having near the free ends of the suspension members approximately horizontal friction pads affixed on top of horizontal lips on the free ends, and said friction pads rubbing against a surface on the underside of the frame whenever said suspension members yield laterally and intended to serve two functions; dampening of oscillations in suspension members and aiding in the vertical support of the bogies.

* * * * *